United States Patent [19]

Tomaszewski et al.

[11] 4,184,929

[45] Jan. 22, 1980

[54] TRIVALENT CHROMIUM PLATING BATH COMPOSITION AND PROCESS

[75] Inventors: Thaddeus W. Tomaszewski, Dearborn, Mich.; Hans-Gerhard Creutz, deceased, late of Yale, Mich., by Katharina A. Creutz, administratrix; Richard J. Clauss, Allen Park, Mich.

[73] Assignee: Oxy Metal Industries Corporation, Warren, Mich.

[21] Appl. No.: 892,603

[22] Filed: Apr. 3, 1978

[51] Int. Cl.[2] ..... C25D 3/06

[52] U.S. Cl. ..... 204/51; 204/43 R

[58] Field of Search ..... 204/51, 43 R; 106/1.25

[56] References Cited

U.S. PATENT DOCUMENTS

| | | | |
|---|---|---|---|
| 3,772,167 | 11/1973 | Bharucha et al. | 204/43 T |
| 3,963,527 | 6/1976 | Lindemann | 106/1.25 X |
| 4,107,004 | 8/1978 | Ward et al. | 204/51 |

OTHER PUBLICATIONS

H. Koretzky, IBM Tech. Disclosure Bulletin, p. 1634, vol. 9, No. 11, Apr. 1967.

*Primary Examiner*—G. L. Kaplan

*Attorney, Agent, or Firm*—Richard P. Mueller

[57] ABSTRACT

An aqueous acid trivalent chromium electroplating solution and process for forming chromium platings employing a bath containing trivalent chromium, formate ions as a complexing agent, and a bath soluble reducing agent selected from the group consisting of formaldehyde, glyoxal, formaldehye bisulfite, glyoxal di-bisulfite, sodium formaldehyde sulfoxylate, and mixtures thereof. The bath may additionally and preferably contain controlled amounts of conductivity salts, ammonium cations and a buffering agent to maintain the pH within the desired range.

11 Claims, No Drawings

TRIVALENT CHROMIUM PLATING BATH COMPOSITION AND PROCESS

BACKGROUND OF THE INVENTION

Chromium plating solutions have been in widespread commercial use for applying protective and decorative platings to metal substrates. For the most part, commercial chromium plating solutions heretofore used have employed hexavalent chromium derived from compounds such as chromic acid, for example, as the source of the chromium constituent. Such hexavalent chromium electroplating solutions have long been characterized as having limited covering power and excessive gassing particularly around apertures in the parts being plated which can result in incomplete coverage. Additionally such hexavlent chromium plating solutions are quite sensitive to current interruptions resulting in a so called "whitewashing" of the deposit.

Trivalent chromium electroplating baths on the other hand have excellent throwing power and the trivalent chromium plating produced is substantially unaffected by current interruptions during the plating cycle. These factors, coupled with the fact that trivalent chromium compounds are much less toxic than hexavalent chromium compounds have provided impetus for the development of improved trivalent chromium plating baths which achieve the benefits of plating deposits derived from hexavalent chromium plating baths while at the same time overcoming other problems heretofore associated with the trivalent chromium plating system. One such problem relates to a progressive reduction in the plating rate during continued use of a trivalent chromium plating bath due to the progressive increase in the concentration of hexavalent chromium formed interfering in the efficiency of the covering power of the bath.

The solution and process of the present invention overcomes certain disadvantages and problems associated with prior art trivalent chromium electroplating solutions in providing improved reducing agents for minimizing and controlling the concentration of hexavalent chromium in the plating solution whereby plating efficiency and throwing power are maintained at optimum levels over prolonged periods of use.

SUMMARY OF THE INVENTION

The benefits and advantages of the present invention are achieved in accordance with the composition aspects of the present invention by an electroplating solution comprising an aqueous acid solution containing from about 0.2 up to about 0.6 molar trivalent chromium, formate ions present to provide a molar ratio of formate to chromium of from about 1:1 to about 3:1, and from about 1 up to about 10 grams per liter (g/l) of a bath soluble reducing agent selected form the group consisting of formaldehyde, glyoxal, formaldehyde bisulfite, glyoxal dibisulfite, sodium formaldehyde sulfoxylate, and mixtures thereof. The bath may further optionally and advantageously contain ammonium ions to impart conductivity and to provide a complexing action to the solution in addition to other conductivity salts of the types and in the amounts generally employed in the art. A buffering agent is also preferably incorported and may comprise boric acid or soluble borate salts. It is also contemplated that the plating solution can optionally contain other co-depositable metals such as iron, cobalt, nickel, manganese, and the like in suitable concentrations in those instances in which an electrodeposit comprising a chromium alloy is desired.

In accordance with the process aspects of the present invention, an aqueous acidic trivalent chromium electroplating bath of the foregoing composition is employed in which work pieces are immersed for a controlled time period while cathodically charged at current densities ranging from about 50 up to about 250 amperes per square foot (ASF). The temperature of the bath is preferably controlled within a range of from about 15° C. up to about 35° C. and the bath constituents are periodically or continuously replenished to compensate for the constituents plated on the metal article and extracted from the bath as a result of drag out. The concentration of the reducing agent is controlled so as to maintain the hexavalent chromium concentration at a level less than about 6 ppm.

Additional benefits and advantages of the present invention will become apparent upon a reading of the description of the preferred embodiments taken in conjunction with the specific examples provided.

DESCRIPTION OF THE PREFERRED EMBODIMENTS

The aqueous acidic trivalent chromium electroplating solution contains as one of its essential constituents trivalent chromium which may range from about 0.2 up to about 0.6 molar and preferably from about 0.3 to about 0.5 molar. The trivalent chromium ions can be introduced in the form of a simple aqueous soluble salt such as chromium chloride hexahydrate, chromium sulfate, and the like. When employing chromium chloride hexahydrate as the source of trivalent chromium equivalent concentrations of about 53 to about 160 g/l provide a corresponding molar concentration of about 0.2 to about 0.6 trivalent chromium.

A second essential constituent of the plating solution is a complexing agent in the form of a formate ion present in a concentration of from about 0.2 to about 1.8 molar dependent on the concentration of trivalent chromium present in the bath. The formate ion serves to complex the trivalent chromium constituent providing for bath stability. The formate ion can be introduced in the form of simple alkali metal or ammonium formate salts of which ammonium formate itself constitutes the preferred material. The formate ion concentration is controlled to provide a molar ratio of formate ion to trivalent chromium ion of from about 1:1 up to about 3:1. Excessive amounts of formate ions are undesirable due to the formation of insoluble complexes. Preferably, the concentration of the formate ion is controlled to provide a formate to chromium molar ratio of about 1:1 to about 1.5:1.

The third essential constituent of the electroplating bath is a reducing agent to prevent the formation of significant amounts of hexavalent chromium during the use of the plating bath. Reducing agents suitable in accordance with the practice of the present invention are formaldehyde, glyoxal, formaldehyde bisulfite, glyoxal di-bisulfite and sodium formaldehyde sulfoxylate. Of the foregoing, formaldehyde bisulfite and glyoxal di-bisulfite constitute the preferred materials due to the presence of a synergistic effect on the reducing characteristics of the compounds named herein and the absence of any detrimental side effects. The formaldehyde bisulfite and glyoxal di-bisulfite are introduced in the form of an aqueous soluble alkali metal salt such as sodium, potassium or lithium as well as alkaline earth metals such as magnesium or calcium, formaldehyde bisulfite or glyoxal di-bisulfite of which the sodium form is preferred. Of the foregoing, sodium formaldehyde bisulfite comprises the preferred material while glyoxal di-sodium bisulfite is next preferred.

Regardless of the specific type of reducing agent employed, the concentration of the reducing agent is controlled within a range of about 1 up to about 10 g/l with concentrations of from about 4 to about 6 g/l being preferred. Generally concentrations above about 10 g/l do not provide any appreciable benefits over lower concentrations and the use of such higher concentration ordinarily cannot be economically justified. In some instances, concentrations of the reducing agent in excess of about 10 g/l also result in some sludging of the solution due to the formation of insoluble chromium formate complexes. It is for this reason that the reducing agent is controlled at a level less than about 10 g/l and preferably within a range of about 4 to about 6 g/l. In any event, the reducing agent is present initially and during continued use of the plating solution to maintain the hexavalent chromium concentration at a level below about 6 ppm's, and preferably at a level below about 2 ppm. Under normal bath operating conditions, the hexavalent chromium concentration will range from 0 up to about 2 ppm. It has been observed that when the hexavalent chromium concentration increases to a level above about 6 ppm, a noticeable reduction in the coverage and thickness of the plating deposit is obtained.

In addition to the foregoing essential constituents, the plating solution optionally, but preferably further contains a controlled amount of conductivity salts which typically comprise salts of alkali metal or alkaline earth metals and strong acids such as hydrochloric acid and sulfuric acid. The inclusion of such conductivity salts is well known in the art and are added for the purpose of increasing the electrical conductivity of the bath and thereby minimize power dissipation during an electroplating operation. Such conductivity salts are usually employed in amounts up to about 250 g/l and even higher depending on the bath concentration, temperature, and operating current density as well as the configuration of the work pieces being plated to achieve optimum performance.

The presence of ammonium ions in the bath also provides advantages in assisting the complexing action of the formate ion. The introduction of simple ammonium salts such as the ammonium salt of strong acids such as hydrochloric or sulfuric acid additionally contributes to the conductivity of the solution enabling the use of lesser amounts of other conventional conductivity salts such as sodium and potassium chloride or sulfate, for example. The concentration of the ammonium ion generally can range from about 0.5 molar up to about 3 molar while concentrations of about 1 to about 2 molar are preferred.

In addition to the foregoing constituents, the plating solution optionally but advantageously can contain a buffering agent of which boric acid or an alkali metal borate salt such as sodium borate, potassium borate, or the like constitute the preferred materials. The concentration of the borate ion is not critical and may range from about 0.5 to about 1.0 molar, while concentrations of about 0.6 to 0.7 molar are preferred.

The bath further contains a hydrogen ion concentration sufficient to render the solution acidic. The concentration of the hydrogen ion preferably is controlled so as to provide a pH of from about 2.5 up to about 4.0 while a pH range of about 2.8 to about 3.2 is particularly satisfactory. The initial adjustment of the bath to within the prescribed pH range can be achieved by the addition of any suitable acid compatible with the bath constituents such as hydrochloric or sulfuric acid. During the use of the plating solution, the bath has a tendency to become more acidic and appropriate pH adjustments can be effected by the addition of an alkali metal hydroxide or ammonium hydroxide with ammonium hydroxide being particularly preferred in that it effects a further replenishment of the ammonium constituent in the bath.

It is also contemplated that the plating bath can contain other metals such as iron, cobalt, nickel, manganese, tungsten or the like in suitable concentrations so that no adverse effects on the chromium bath occur when it is desired to deposit platings comprised of a chromium alloy. It is generally preferred to maintain the concentration of iron, if present, to levels below about 0.5 g/l.

In addition to the foregoing constituents, the electroplating solution may additionall contain small but effective amounts of wetting agents and anti-foaming agents of any of the types well known in the art which are conventionally employed in electroplating solutions and which are compatible with the specific constituents of the bath. The concentration of such wetting agents and anti-foaming agents when employed may conveniently range from about 0.01 up to about 2 g/l.

It will be apparent from the foregoing that the plating solution in accordance with the preferred embodiments of the present invention comprises an aqueous acidic solution containing trivalent chromium a complexing agent, a reducing agent, ammonium ions, a conductivity salt, a hydrogen ion concentration to provide the appropriate pH, a buffering agent and optionally a wetting agent and secondary metals to produce an alloy plating. The foregoing plating solution is particularly satisfactory for use in chloride-type trivalent plating baths although beneficial effects are also attained when employing sulfate-type plating baths.

In accordance with the process aspects of the present invention, a plating solution is prepared incorporating the constituents as hereinabove set forth in the appropriate concentrations. The operating temperature of the plating bath may range from about 15° C. up to about 35° C. while temperatures of from about 20° C. to about 25° are preferred. Current densities during operation can range from about 50 up to about 250 amperes per square foot while current densities of about 75 to 125 ASF are preferred. The workpieces to be plated are subjected to conventional pretreatment in accordance with prior art practice and the process is particularly effective to deposit chromium platings on articles which have been subjected to a prior nickel plating operation.

Preparation of the electroplating solution is simply achieved by sequentially dissolving the individual aqueous soluble constituents in water to provide a concentration within the limits hereinbefore set forth. A replenishment of the solution to maintain the pH, trivalent chromium content, reducing agent and other bath constituents within the permissible operating ranges may conveniently be achieved by emloying ammonium hydroxide for pH conrol which simultaneously effects a replenishment of the ammonium ion, while the trivalent chromium and other additive consituents are replenished using dry solids.

In the operation of the plating bath, the workpieces to be plated are cathodically charged and the bath incorporates a suitable anode of a material which will not adversely effect and which is compatible with the solution composition. For this purpose anodes of an inert material such as carbon for example are preferred although other inert anodes of titanium or platinum can also be employed.

In order to further illustrate the composition and method of the present invention, the following specific examples are provided. It will be understood that the examples are provided for illustrative purposes and are not intended to limiting of the invention as herein disclosed and as set forth in the subjoined claims.

EXAMPLE 1

A trivalent chromium electroplating solution is prepared by dissolving the following constituents in water to produce a resultant concentration as set forth:

| Constituent | Concentration, g/l |
|---|---|
| Chromium chloride hexahydrate | 92 |
| Ammonium formate | 55 |
| Glyoxal | 5 |
| Ammonium Chloride | 90 |
| Potassium Chloride | 75 |
| Boric Acid | 50 |
| Wetting Agent* | (0.1% by volume) |

*dihexyl sulfosuccinate

Operation of the bath at a temperature of from about 20° C. to 25° C. at a current density of about 100 ASF and at a pH of about 2.9 utilizing mild air agitation provides for satisfactory uniform chromium plating.

EXAMPLE 2

An electroplating solution is prepared by dissolving the following constituents in water to provide a final concentration as follows:

| Constituent | Concentration, g/l |
|---|---|
| Chromium Chloride hexahydrate | 90–100 |
| Ammonium formate | 27.5–55 |
| Glyoxal di-sodium bisulfite | 1.5 |
| Ammonium chloride | 54–100 |
| Potassium chloride | 50–75 |
| Boric acid | 40–50 |

The electroplating bath is operated at a temperature ranging from 20° C. to 25° C. at a pH of from 2.5 to about 3.5 and at a current density of 100 ASF utilizing mild air agitation. Uniform chromium deposits are produced.

EXAMPLE 3

An electroplating solution is prepared by dissolving the following constituents in the concentrations as set forth below:

| Constituent | Concentration, g/l |
|---|---|
| Chromium chloride hexahydrate | 100 |
| Ammonium formate | 55 |
| Sodium formaldehyde bisulfite | 4 |
| Ammonium chloride | 90 |
| Sodium chloride | 58 |
| Boric acid | 40 |

-continued

| Constituent | Concentration, g/l |
|---|---|
| Wetting Agent* | (0.2 ml/l) |

*dihexyl sulfosuccinate

Satisfactory operation of the plating bath is obtained at a pH of about 3.0 and at a temperature ranging from about 20° C. to 25° C. at a current density of 100 ASF utilizing mild air agitation. Satisfactory chromium platings are obtained over a period of from one to three minutes.

EXAMPLE 4

An electroplating solution is prepared employing the following constituents in the concentration as set forth:

| Constituent | Concentration, g/l |
|---|---|
| Chromium chloride hexahydrate | 100 |
| Ammonium formate | 55 |
| Sodium formaldehyde bisulfite | 4 |
| Ammonium chloride | 90 |
| Potassium chloride | 74 |
| Boric acid | 40 |
| Wetting agent* | (0.2 ml/l) |

*dihexyl sulfosuccinate

Satisfactory plating is achieved employing the foregoing bath at a temperature ranging from 20° C. to 25° C. at a pH of about 3.0 and at a current density of 100 ASF utilizing mild air agitation. Satisfactory chromium platings are obtained employing plating times ranging from one to three minutes.

EXAMPLE 5

An electroplating solution is prepared employing the constituents in the concentrations as follows:

| Constituent | Concentration, g/l |
|---|---|
| Chromium chloride hexahydrate | 100 |
| Ammonium formate | 55 |
| Sodium formaldehyde bisulfite | 4 |
| Ammonium chloride | 90 |
| Sodium sulfate | 142 |
| Boric acid | 40 |
| Wetting agent* | (0.2 ml/l) |

*dihexyl sulfosuccinate

Satisfactory operation of the plating bath is obtained at an operating pH of about 3.0 and at a temperature ranging from 20° to about 25° C. utilizing mild air agitation. Satisfactory chromium platings are produced at a current density of 100 ASF within a time period of from one to three minutes.

EXAMPLE 6

An electroplating solution is prepared incorporating the constituents in the concentrations as hereinafter set forth:

| Constituent | Concentration, g/l |
|---|---|
| Chromium chloride hexahydrate | 100 |
| Ammonium formate | 55 |
| Sodium formaldehyde bisulfite | 4 |
| Ammonium chloride | 90 |
| Magnesium chloride hexahydrate | 100 |
| Boric acid | 40 |

-continued

| Constituent | Concentration, g/l |
|---|---|
| Wetting agent* | (0.02) |

*stearyl dimethyl amine propane sultone

In operation, the electroplating solution is at a temperature ranging from 20° C. to about 25° C. and at a pH of about 3.0 utilizing mild air agitation. Satisfactory chromium platings are obtained within a period of one to three minutes at a current density of 100 ASF.

EXAMPLE 7

An electroplating solution is prepared employing the constituents in the concentrations as set forth below:

| Constituent | Concentration, g/l |
|---|---|
| Chromium chloride hexahydrate | 100 |
| Ammonium formate | 55 |
| Sodium formaldehyde bisulfite | 4 |
| Ammonium chloride | 90 |
| Magnesium sulfate heptahydrate | 180 |
| Boric acid | 40 |
| Wetting agent* | 0.02 |

*Stearyl dimethyl amine propane sultone

Satisfactory chromium platings are obtained employing the aforementioned bath at a temperature of from about 20° to about 25° C. at a pH of 3.0 at a current density of 100 ASF, employing plating times ranging from about one to about three minutes and utilizing mild air agitation.

EXAMPLE 8

An electroplating solution is prepared employing the constituents in the concentrations as follows:

| Constituent | Concentration, g/l |
|---|---|
| Chromium chloride hexahydrate | 100 |
| Ammonium formate | 55 |
| Formaldehyde | 0.1 |
| Ammonium chloride | 90 |
| Sodium sulfate | 142 |
| Boric acid | 40 |
| Wetting agent* | (0.2 ml/l) |

*dihexyl sulfosuccinate

Satisfactory operation of the plating bath is obtained at an operating pH of about 3.0 and at a temperature ranging from 20° to about 25° C. utilizing mild air agitation. Satisfactory chromium platings are produced at a current density of 100 ASF within a time period of from one to three minutes.

EXAMPLE 9

An electroplating solution is prepared by dissolving the following constituents in the concentrations as set forth below:

| Constituent | Concentration, g/l |
|---|---|
| Chromium chloride hexahydrate | 100 |
| Ammonium formate | 55 |
| Sodium formaldehyde sulfoxylate | 1 |

-continued

| Constituent | Concentration, g/l |
|---|---|
| Ammonium chloride | 90 |
| Sodium chloride | 58 |
| Boric acid | 40 |
| Wetting agent* | (0.2 ml/l) |

*dihexyl sulfosuccinate

Satisfactory operation of the plating bath is obtained at a pH of about 3.0 and at a temperature ranging from about 20° C. to 25° C. at a current density of 100 ASF utilizing mild air agitation. Satisfactory chromium platings are obtained over a period of from one to three minutes.

What is claimed is:

1. An aqueous acid trivalent chromium electroplating solution containing from about 0.2 to about 0.6 molar trivalent chromium, no more than about 6 parts per million hexavalent chromium, from about 0.2 to about 1.8 molar formate ions, and from about 1 to about 10 grams per liter of a bath soluble reducing agent selected from the group consisting of formaldehyde, glyoxal, formaldehyde bisulfite salts, glyoxal di-bisulfite salts, sodium formaldehyde sulfoxylate, and mixtures thereof, the molar ratio of formate to trivalent chromium in said solution being from about 1:1 up to about 3:1.

2. The electroplating solution as defined in claim 1 further including a hydrogen ion concentration to provide a pH of about 2.5 to about 4.0.

3. The electroplating solution as defined in claim 1 further including a buffering agent selected from the group consisting of boric acid, borates, and mixtures thereof.

4. The electroplating solution as defined in claim 1 further including ammonium ions in an amount of about 0.5 to about 3 molar.

5. The electroplating solution as defined in claim 1 in which said trivalent chromium is present in an amount of from about 0.3 to about 0.5 molar.

6. The electroplating solution as defined in claim 1 further including a hydrogen ion concentration to provide a pH of about 2.8 to about 3.2.

7. The electroplating solution as defined in claim 1 further including ammonium ions present in an amount to provide a molar concentration of from about 1 up to about 2.

8. The electroplating solution as defined in claim 1 in which the concentration of said formate ions is present to provide a molar ratio of formate ions to trivalent chromium ions ranging from about 1:1 to about 1.5:1.

9. The electroplating solutions as defined in claim 1 in which said reducing agent comprises sodium formaldehyde bisulfite.

10. The electroplating solution as defined in claim 1 in which said reducing agent comprises glyoxal di-sodium bisulfite.

11. A process for electroplating chromium on a cathode which comprises the steps of immersing a cathode to be electroplated in an aqueous trivalent chromium electroplating solution as defined in claim 1, maintaining said solution at a pH of about 2.5 to about 4 and at a temperature of about 15° C. to about 35° C., applying an electrical current between an anode and said cathode to provide a current density of about 50 to about 250 ASF for a period of time to electrodeposit the desired thickness of chromium on said cathode.

* * * * *